US011769991B2

(12) United States Patent
Borja et al.

(10) Patent No.: US 11,769,991 B2
(45) Date of Patent: Sep. 26, 2023

(54) GLOW DISCHARGE TUBE WITH A SET OF ELECTRODES WITHIN A GAS-SEALED ENVELOPE

(71) Applicant: Unison Industries, LLC, Jacksonville, FL (US)

(72) Inventors: Juan P. Borja, Latham, NY (US); Joseph Darryl Michael, Delmar, NY (US); Matthew Jason Pittman, Jacksonville, FL (US); Peter John Desalvo, Jacksonville, FL (US); Matthew Michael Langenderfer, Flagler Beach, FL (US)

(73) Assignee: Unison Industries, LLC, Jacksonville, FL (US)

( * ) Notice: Subject to any disclaimer, the term of this patent is extended or adjusted under 35 U.S.C. 154(b) by 0 days.

(21) Appl. No.: 17/494,443

(22) Filed: Oct. 5, 2021

(65) Prior Publication Data

US 2023/0104635 A1 Apr. 6, 2023

(51) Int. Cl.

| | |
|---|---|
| ***H01T 1/20*** | (2006.01) |
| ***H01T 15/00*** | (2006.01) |
| ***H01J 17/44*** | (2006.01) |

(52) U.S. Cl.

CPC ..... *H01T 1/20* (2013.01); *H01J 17/44* (2013.01); *H01T 15/00* (2013.01)

(58) Field of Classification Search

None

See application file for complete search history.

(56) References Cited

U.S. PATENT DOCUMENTS

| | | | | |
|---|---|---|---|---|
| 2,415,816 | A | 2/1947 | Depew et al. | |
| 3,524,101 | A | 8/1970 | Spartacus | |
| 3,526,907 | A | 9/1970 | Marshall | |
| 4,437,039 | A * | 3/1984 | Larson | H01J 61/54 315/56 |
| 4,484,106 | A | 11/1984 | Taylor et al. | |
| 4,771,168 | A | 9/1988 | Gundersen et al. | |
| 4,890,040 | A | 12/1989 | Gundersen | |
| 3,173,075 | A1 | 5/2012 | Gutsol et al. | |
| 9,341,610 | B1 | 5/2016 | McIver et al. | |
| 9,399,954 | B2 | 7/2016 | Wright | |
| 9,484,717 | B2 | 11/2016 | Strong et al. | |
| 9,806,501 | B1 | 10/2017 | Sommerer | |
| 9,825,434 | B2 | 11/2017 | Heid et al. | |
| 10,995,672 | B2 | 5/2021 | Ramamurthi et al. | |
| 2012/0187871 | A1 | 7/2012 | Fantz et al. | |
| 2015/0188292 | A1 | 7/2015 | Strong et al. | |

(Continued)

FOREIGN PATENT DOCUMENTS

| | | |
|---|---|---|
| CN | 201541052 U | 8/2010 |
| EP | 0062782 B1 | 8/1985 |

(Continued)

*Primary Examiner* — Ashok Patel
(74) *Attorney, Agent, or Firm* — McGarry Bair PC

(57) ABSTRACT

A glow discharge tube comprising a gas-sealed envelope, a first electrode, and a second electrode. The gas-sealed envelope defining an interior with an interior surface defining a first interior portion with a first interior surface and a second interior portion with a second interior surface. The first electrode being located within the first interior portion, and the second electrode being located within and in contact with the second interior portion.

20 Claims, 7 Drawing Sheets

(56) References Cited

U.S. PATENT DOCUMENTS

| | | | | |
|---|---|---|---|---|
| 2015/0249322 | A1 | 9/2015 | Heid et al. | |
| 2015/0260107 | A1 | 9/2015 | Wright | |
| 2016/0226225 | A1 | 8/2016 | Girard et al. | |
| 2018/0051633 | A1 | 2/2018 | Michael et al. | |
| 2020/0126782 | A1* | 4/2020 | Zhang ..... | H01J 61/50 |

FOREIGN PATENT DOCUMENTS

| | | | |
|---|---|---|---|
| EP | 0979548 | B1 | 3/2001 |
| EP | 1858129 | A2 | 11/2007 |
| FR | 2984028 | A1 | 6/2013 |

* cited by examiner

GLOW DISCHARGE TUBE WITH A SET OF ELECTRODES WITHIN A GAS-SEALED ENVELOPE

TECHNICAL FIELD

The disclosure generally relates to a glow discharge tube, and more specifically to a glow discharge tube with a set of electrodes.

BACKGROUND

Spark gaps are passive, two-terminal switches that are open when the voltage across the terminals is low, and then close when the voltage across the terminals exceeds a design value (e.g., 1 kV to 3 kV). The spark gap then re-opens when the current has fallen to a low level or when most of the energy from the voltage source is dissipated. Internally the current is carried between two metal electrodes that are separated by a small gap (~mm) that is filled with a gas or gas mixture near atmospheric pressure. The gas is ordinarily insulating, but it becomes a conducting plasma spark when the voltage between the two electrodes exceeds the design value which corresponds to the breakdown voltage.

For various applications, one parameter of interest may be the time between when a sufficient voltage is applied to the spark gap and the time at which it becomes conducting. This time corresponds to the breakdown processes that initiate the transition of the gas from an insulator to a conductor.

Electrical breakdown can be viewed as a two-step process—a statistical time for the first electron to appear, followed by a formative time for the electrons to avalanche to a highly conductive state. A free electron appears at some time and location in the gap, and is accelerated by the electric field that is created by the potential difference between the electrodes. Once the electron gains sufficient energy there is some probability for it to ionize a gas atom or molecule and release a second free electron. Each electron is then accelerated and the process repeats, leading to an electron avalanche that makes the gas highly conducting. The energy gain and multiplication processes must overcome various energy and particle loss processes, and first free electron should be created in preferred locations (e.g., at or near the negative electrode) for maximum effectiveness.

The time required for the second (avalanching) process is the formative time lag. It is generally short and can be practically ignored. Thus, the time required for the first process (the initial electron) is the statistical time lag, and it is this first electron problem that is of primary interest in practice. In some devices such as laboratory apparatus or large electric discharge lamps the first electron problem is solved by waiting for a cosmic ray to create a free electron when it collides with a gas atom, gas molecule, or surface within the device. Electron-ion pairs are always being created at a given rate in atmospheric air by energetic cosmic rays that can easily penetrate into gas volumes within devices and structures. However, the ubiquitous cosmic-ray process cannot be relied upon to create effective free electrons within a required timeframe that may be needed for reliable operation of many devices that incorporate a spark gap. In particular, for device employing a spark gap the timeframe is typically too short to rely on a cosmic ray-based process because the interaction volume (the gas region between the electrodes) is relatively small.

Instead, the conventional approach to solving the first-electron problem in a spark gap context (as well as in other devices dealing with similar issues, such as small electric discharge lamps) is to add a source of radioactivity, for example in the form of radioactive krypton-85, which undergoes beta decay to emit an energetic electron, to generate seed electrons and reduce statistical time-lag to acceptable values. Other radioactive materials such as tritium or thorium are sometimes used. The addition of a radioactive component is sometimes referred to as radioactive prompting. However, radioactive materials, even at trace level, are generally not desirable in a component or product because these materials add to of the cost of manufacturing, handling, and shipping.

BRIEF DESCRIPTION OF THE DRAWINGS

A full and enabling disclosure of the present description, including the best mode thereof, directed to one of ordinary skill in the art, is set forth in the specification, which refers to the appended FIGS., in which.

DETAILED DESCRIPTION

Figure 1:
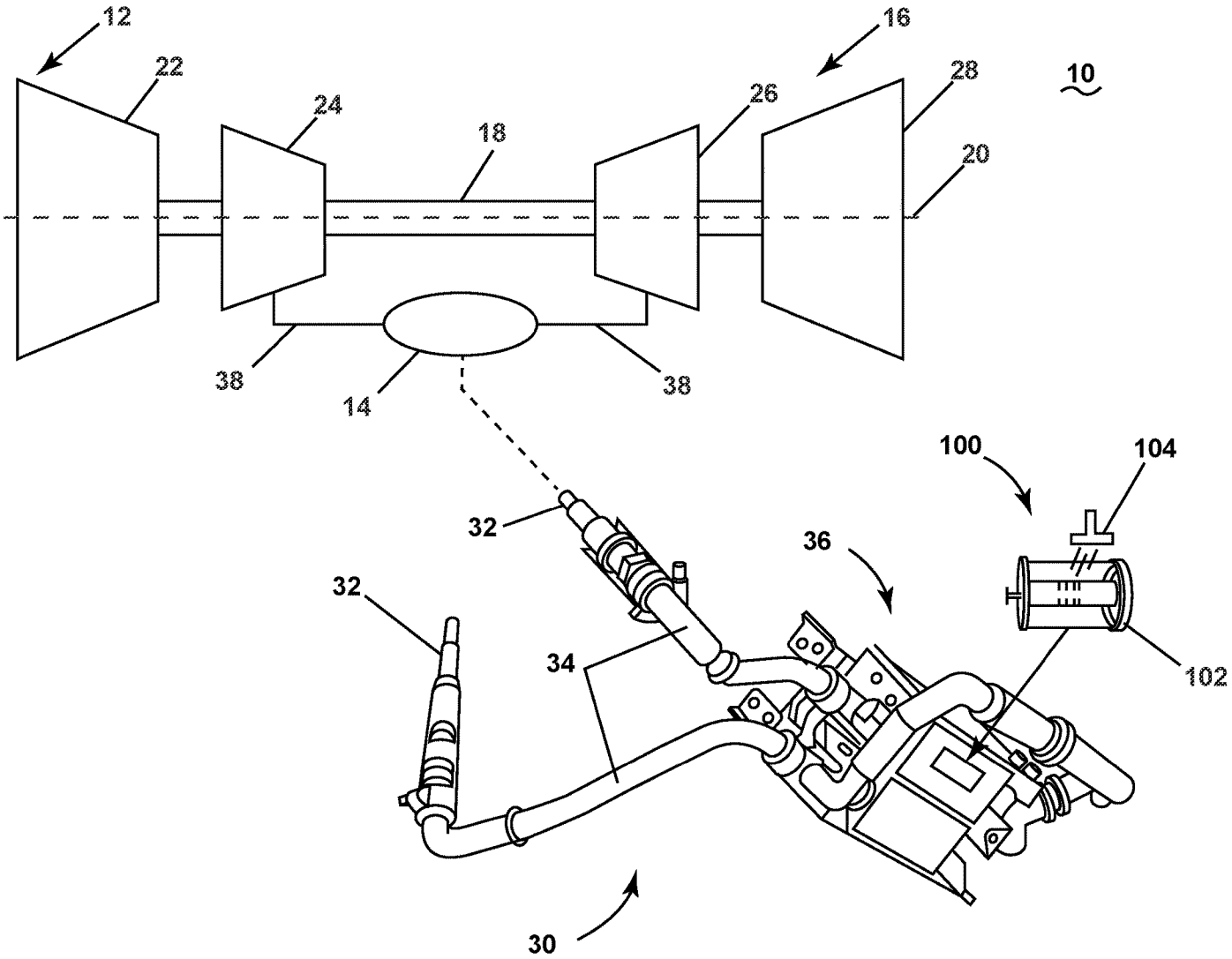
FIG. 1 is a schematic perspective view of a turbine engine including an ignition device with a spark gap device and a light source.

Aspects of the disclosure described herein are broadly directed to an ignition device for a combustion engine. As a non-limiting example, aspects of the disclosure described herein are directed to an ignition device for a turbine engine including a combustion section. The ignition device can include a spark gap device in combination with a light source having a glow discharge tube. The spark gap device can be a radiation-free spark gap device. The glow discharge tube can include a sealed tube with a first electrode and a second electrode disposed within an interior of the sealed tube. A gas-sealed envelope can at least partially encase the first electrode and the second electrode.

The glow discharge tube can be used to generate a light or photon emission through an electron breakdown event as described herein, thus defining the light source. This photon emission can impinge against at least one electrode within the spark gap device, which, in turn, can cause electron emission within the spark gap device. The glow discharge tube as described herein can be used to generate a sufficient photon emission even under dark conditions. As used herein, the term "dark conditions" or iterations thereof can refer to an environment that would cause the photon emission from the glow discharge tube to have a wavelength that is not sufficient in generating electron emission from the electrodes in the spark gap device.

For the purposes of illustration, one exemplary environment within which the ignition device can be utilized will be described in the form of a turbine engine. Such a turbine engine can be in the form of a gas turbine engine, a turboprop, turboshaft or a turbofan engine having a power gearbox, in non-limiting examples. It will be understood, however, that aspects of the disclosure described herein are not so limited and can have general applicability within any suitable combustion engine including an ignition device. For example, the disclosure can have applicability for an ignition device in other engines or vehicles, and can be used to provide benefits in industrial, commercial, and residential applications.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

Additionally, as used herein, the terms "radial" or "radially" refer to a direction away from a common center. For example, in the overall context of a turbine engine, radial refers to a direction along a ray extending between a center longitudinal axis of the engine and an outer engine circumference. Furthermore, as used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, secured, fastened, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor and turbine sections 12, 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

The turbine engine 10 can further include, or otherwise be operably coupled to a fuel ignition system 30. As a non-limiting example, the combustion section 14 can include or otherwise be operably coupled to the ignition system 30. The ignition system 30 can include a set of igniters 32, an exciter 36, and a set of leads 34 operably connecting the set of igniters 32 to the exciter 36. As a non-limiting example, at least a portion of the igniters 32 can extend into the combustion section 14 or otherwise be directly coupled to the combustion section 14. An ignition device 100 can be provided within the exciter 36. As illustrated, the ignition device 100 can include a spark gap device 102 and a light source including a glow discharge tube 104. Although a single ignition device 100 is illustrated, it will be appreciated that the exciter 36 can include any number of one more ignition devices 100.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited by the ignition system 30 (e.g., by the set of igniters 32), thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The pressurized airflow and the combustion gases can together define a working airflow 38 that flows through the fan, compressor section 12, combustion section 14, and turbine section 16 of the turbine engine 10.

Ignition within the combustion section 14 can occur through generation of a spark within the ignition device 100. As a non-limiting example, the spark can be generated within the spark gap device 102. The spark, in turn, can cause electron emission from the corresponding set of igniters 32. The electron emission from the set of igniters 32 can ignite the fuel-air mixture within the combustion section 14 and cause ignition and combustion, thus generating the combustion gases.

Figure 2:
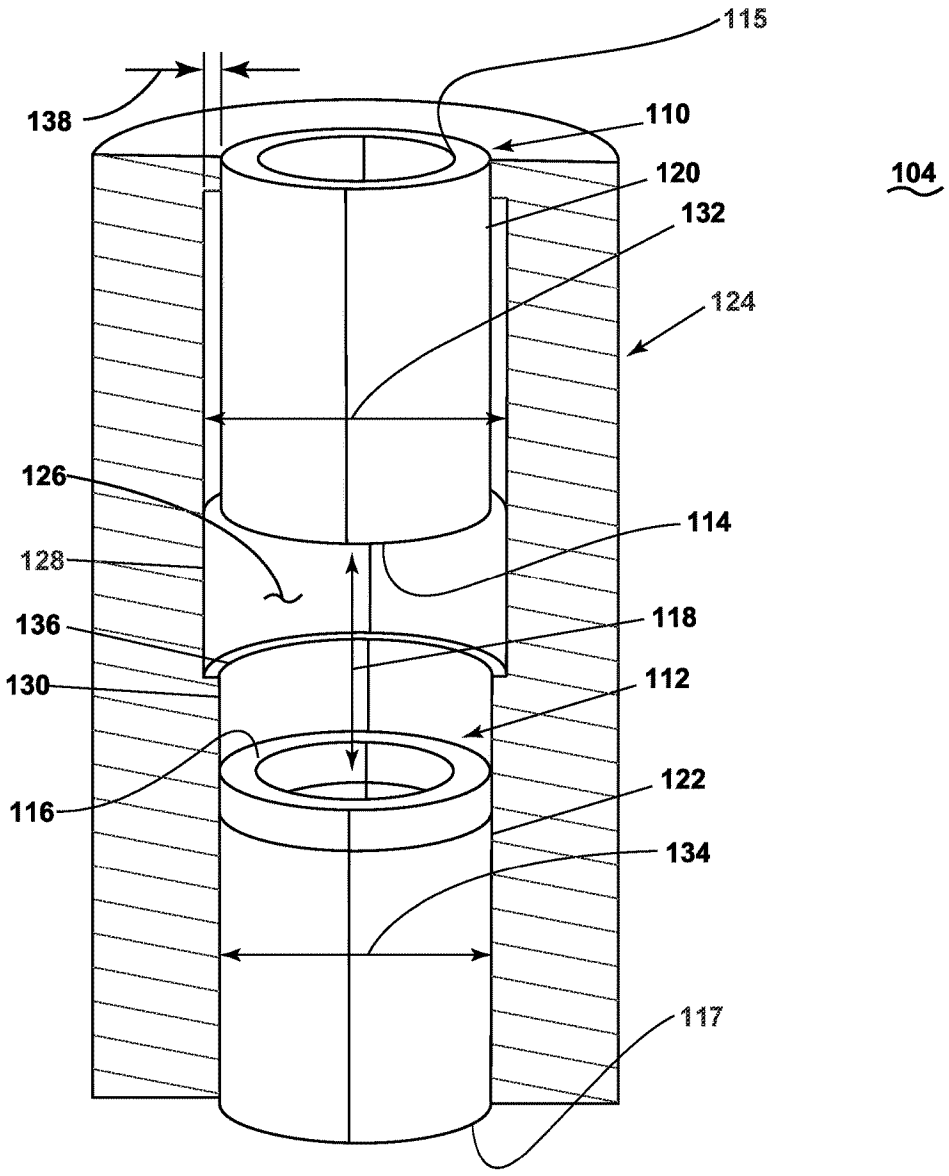
FIG. 2 is a cross-sectional perspective view of the glow discharge tube of FIG. 1, further illustrating a first electrode and a second electrode encased within a gas-sealed envelope.

FIG. 2 is a cross-sectional perspective view of the glow discharge tube 104 of FIG. 1. The glow discharge tube 104 can include a gas-sealed envelope 124 defining an interior 126. A set of opposing electrodes can be provided within the interior 126. As a non-limiting example, the set of opposing electrodes can include a first electrode 110 and a second electrode 112 provided within the interior 126.

The first electrode 110 and the second electrode 112 can be defined by their relative charge with respect to one another. As a non-limiting example, the first electrode 110 can be positively charged, thus defining an anode, while the second electrode 112 can be negatively charged, thus defining a cathode. Alternatively, the first and second electrodes 110, 112 can be cathode/anode, instead of anode/cathode.

The first electrode 110 and the second electrode 112 of the glow discharge tube 104 can be any suitable electrode such as, but not limited to, a wire electrode, pointy electrodes or any combination thereof. The first electrode 110 and the second electrode 112 can be made of any suitable material for an electrode such as, but not limited to, nickel. The first electrode 110 and the second electrode 112 can further include a generally cylindrical form. Alternatively, the first electrode 110 and the second electrode 112 can include any suitable shape such as, but not limited to, spherical, rectangular, triangular, or any combination thereof. As illustrated, the first electrode 110 and the second electrode 112 can each include a hollow interior. It is contemplated that the hollow interior can help during the breakdown process and generation of the electric field within the glow discharge tube 104. Further yet, the hollow interior can result in an electrode that requires less material than an electrode without the hollow interior.

The first electrode 110 can include a first distal end 114, while the second electrode can include a second distal end 116, opposing the first distal end 114. The first electrode 110 can extend between the first distal end 114 and a third distal end 115. The second electrode 112 can extend between the second distal end 116 and a fourth distal end 117. The first distal end 114 and the second distal end 116 can be spaced apart from one another and define a distance 118 therebetween. As a non-limiting example, the distance 118 can be between 3 mm and 6 mm. It is contemplated that the distance 118 can be adjusted based on the nominal operating voltage of the glow discharge tube 104. As illustrated, both the first distal end 114 and the second distal end 116 can be defined by the same planar or an otherwise flat topography. However, both the first distal end 114 and the second distal end 116 can have the same or different topography, which can be planar or non-planar.

The first electrode 110 can further have a first exterior portion defined by a first exterior surface 120. The first exterior surface 120 can interconnect the first distal end 114 and the third distal end 115. The second electrode can also have a second exterior surface defined by a second exterior surface 122. The second exterior surface 122 can interconnect the second distal end 116 and the fourth distal end 117.

As discussed herein, the first electrode 110 and the second electrode 112 can have a generally cylindrical form such that the first exterior surface 120 and the second exterior surface 122 can define the outer circumference of the cylinder. The first electrode 110 and the second electrode 112 can be sized and shaped such that the first electrode 110 is a mirror image of the second electrode 112. As a non-limiting example, the first electrode 110 can have the same cross-sectional area or diameter as the second electrode 112. Alternatively, the first electrode 110 can be larger or smaller, or shaped differently than the second electrode 112.

The glow discharge tube 104 can further include the gas-sealed envelope 124 including the interior 126 and at least partially encasing the first electrode 110 and the second electrode 112. Although illustrated as open (e.g., the hollow interior) it will be appreciated that the first electrode 110 and the second electrode 112 can be sealed along the third distal end 115 or the fourth distal end 117, respectively. As such, the interior 126 of the gas-sealed envelope 124 is fully sealed. It is contemplated that at least one of the first electrode 110 and the second electrode 112 such that at least one of the third distal end 115 or the fourth distal end 117 extends past the gas-sealed envelope 124. It is contemplated that the gas-sealed envelope 124 can fully encase the first electrode 110 and the second electrode 112 such that they are sealed within the interior 126. As a non-limiting example, the first electrode 110 can be at least partially provided within or encased by a first interior portion of the gas-sealed envelope 124, while the second electrode 112 can be at least partially provided within or encased by a second interior portion of the gas-sealed envelope 124.

As illustrated, the gas-sealed envelope 124 can be formed to correspond to the first electrode 110 and the second electrode 112. In other words, the gas-sealed envelope can be formed as a generally cylindrical form with a hollow interior. The gas-sealed envelope 124 can further be defined by a first interior portion defined by a first interior surface 128, and a second interior portion defined by a second interior surface 130, each defining an inner circumference of the gas-sealed envelope 124 or an outer circumference of the interior 126. As a non-limiting example, the first interior surface 128 can confront the first exterior surface 120, while the second interior surface 130 confronts the second exterior surface 122.

The first interior portion can define a first cross-sectional area 132, while the second interior portion can define a second cross-sectional area 134. The first electrode 110 can be at least partially received within the first interior portion while the second electrode 112 can be at least partially located within the second interior portion. As illustrated, the first cross-sectional area 132 can be larger than the second cross-sectional area 134 such that a shelf 136 is formed between a junction between first interior portion and the second interior portion. As illustrated, the shelf 136 can extend normal to the first interior surface 128 and the second interior surface 130 to form an abrupt change in cross-sectional area between the first cross-sectional area 132 and the second cross-sectional area 134. It will be appreciated, however, that this region can include any suitable transition between the first interior portion and the second interior portion. As a non-limiting example, the first cross-sectional area 132 can decrease non-abruptly forming either a linear or non-linear transition between the first cross-sectional area 132 and the second cross-sectional area 134.

The gas-sealed envelope 124 can further be made of a dielectric material such as, but not limited to, glass, ceramic (e.g., silicon dioxide, quartz, alumina, etc.) or any combination thereof. As such, the gas-sealed envelope 124 can further be defined as a dielectric gas-sealed envelope 124. As a non-limiting example, the gas-sealed envelope can have a 0.9 mm thickness and include a permeability of 3-9.

The first cross-sectional area 132 can be sized such that it is larger than the diameter of the first electrode 110. As such, a gap 138 can be formed between the first exterior surface 120 and the first interior surface 128. As a non-limiting example, the gap 138 can be 0.1 mm. The gap 138 can be constant about the entire periphery of the first electrode 110. Alternatively, the gap 138 can be non-constant about the entire periphery of the first electrode 110. The second cross-sectional area 134 can be sized such that it is equal to the cross-sectional area of the second electrode 112. As such, the gas-sealed envelope 124 can be sized such that the second interior surface 130 contacts the second exterior surface 122.

The interior 126 of the gas-sealed envelope 124 can include a gas. As a non-limiting example, the gas can be a non-radioactive gas or otherwise include an inert gas such as, but not limited to, nitrogen, argon, helium, neon, krypton, or any combination thereof. As a non-limiting example, a pressure of the gas within the gas-sealed envelope 124 can be between 75 Torr and 150 Torr. As a non-limiting example, the gas-sealed envelope 124 can define a vacuum.

During operation of the glow discharge tube 104, a voltage (e.g., a Direct Current (DC) voltage) can be applied to at least one of the first electrode 110 or the second electrode 112 from a power source. The voltage can cause an electric field to be generated between the first electrode 110 and the second electrode 112 and for field emission or electron emission to occur within the glow discharge tube 104. As a non-limiting example, field emission can occur from the second distal end 116 of the second electrode 112. With the generation of the electric field, a breakdown event within the glow discharge tube 104 can occur. As used herein, the term "breakdown event" can refer to the time it takes or otherwise the process of emitting an electron from at least one of the electrodes and the time or process for the emitted electrons to avalanche to a highly conductive state.

As the gas-sealed envelope 124 includes a dielectric material, the contact between the gas-sealed envelope 124 and the second electrode 112 can aid in the generation of the electric field within the glow discharge tube 104. As a non-limiting example, the contact between the gas-sealed envelope 124 and the second electrode 112 can generate a triple-point emission. As used herein, the term "triple-point emission" or iterations thereof can refer the process of emitting an electron (e.g., field emission) from a surface where a conductor (e.g., the second distal end 116 of the second electrode 112), an insulator (e.g., the dielectric material of the gas-sealed envelope 124), and a gas or vacuum (e.g., the gas or vacuum within the interior 126) come into contact at a point or a boundary and the local electric field can be very high when compared to a glow discharge tube that includes electrodes that do not contact a dielectric surface. In other words, field emission can occur at the intersection of these three mediums, hence the triple point. The difference in a surface potential between the adjacent conducting and insulating regions leads to the formation of very high electric fields at the boundary between the two regions. The electric fields then pull electrons from the conducting material by electric field emission. As a non-limiting example, the very high electric fields can be between 10 and 20 Volts/micron.

The gap 138 can be used to stop, limit, or otherwise restrict the possible conduction of surface electrons along the dielectric material (e.g., the gas-sealed envelope 124). This, in turn, can force a breakdown event to occur between the first electrode 110 and the second electrode through the triple-point emission. It is contemplated that the electric field generated within the glow discharge tube 104 can be between 1 and 3 Volts/micron. As a non-limiting example, electric field can be varied based on the composition of the gas within the interior 126 of the gas-sealed envelope 124.

Figure 3:
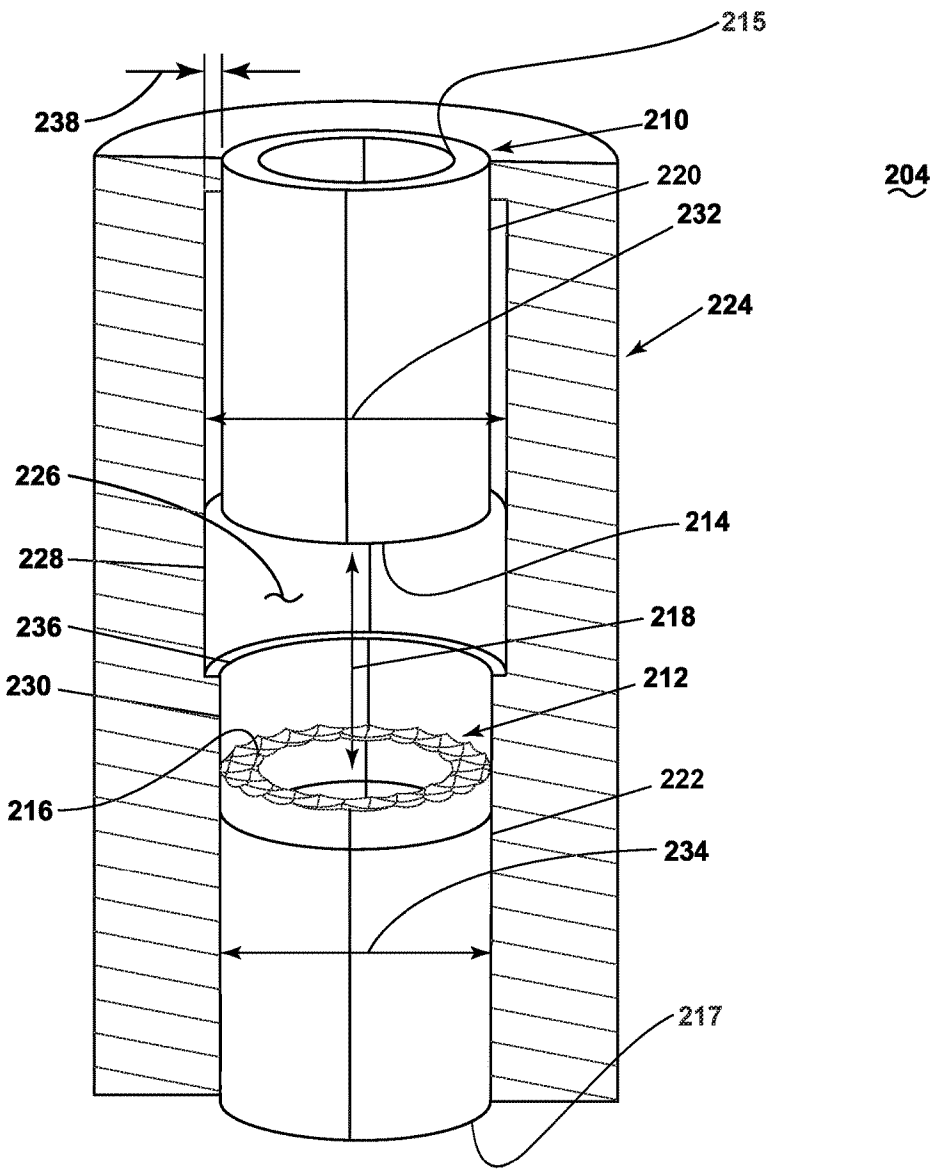
FIG. 3 is a cross-sectional perspective view of an exemplary glow discharge tube of FIG. 2, further illustrating an exemplary second electrode including a non-planar topography.

FIG. 3 is a cross-sectional perspective view of an exemplary glow discharge tube 204 of FIG. 2. The glow discharge tube 204 is similar to the glow discharge tube 104, therefore, like parts will be identified with like numerals increased to the 200 series, with it being understood that the description of the like parts of the glow discharge tube 104 applies to the glow discharge tube 204 unless otherwise noted. It will be appreciated that the glow discharge tube 204 can be suitable for use within the ignition device 100.

The glow discharge tube 204 is similar to the glow discharge tube 104 as it includes a gas-sealed envelope 224 defining a second interior 226, a first electrode 210, and a second electrode 212, with both the first electrode 210 and the second electrode 212 being disposed within the second interior 226. The gas-sealed envelope 224 can be similar to the gas-sealed envelope 124 in that it includes a first interior portion defined by a first interior surface 228 and defining a first cross-sectional area 232, a second interior portion defined by a second interior surface 230 and defining a second cross-sectional area 234, and a shelf 236 defining a transition region between the first cross-sectional area 232 and the second cross-sectional area 234. The first electrode 210 can be at least partially provided within or encased by the first interior portion of the gas-sealed envelope 224. The second electrode 212 can be at least partially provided within or encased by the second interior portion of the gas-sealed envelope 224. The first cross-sectional area 232 can be sized such that a gap 238 is formed between the first interior surface 228 and the first exterior surface 220, while the second cross-sectional area 234 can be sized such that the second interior surface 230 contacts the second electrode 212. The first electrode 210 can be similar to the first electrode 110 in that it can include a first distal end 214 and a third distal end 215 interconnected by a first exterior surface 220. The second electrode 212 can be similar to the second electrode 112 in that it includes a second distal end 216, opposing the first distal end 214, and a fourth distal end 217 interconnected by a second exterior surface 222. The first electrode 210 and the second electrode 212 can be spaced apart from one another such that first distal end 214 and the second distal end 216 can be spaced apart a distance 218 from one another.

The glow discharge tube 204 differs from the glow discharge tube 104 in that the first distal end 214 of the first electrode 210 and the second distal end 216 of the second electrode 212 do not include the same topography. The first distal end 214, similar to the first distal end 114, can include a planar or otherwise flat topography. The second distal end 216, however, can be defined by a non-planar topography. As a non-limiting example, the non-planar topography can be a knurled or diamond-shaped topography.

It will be appreciated that the non-planar topography can be formed as a part of the first electrode 210 or the second electrode 212 through any suitable method. As a non-limiting example, the non-planar topography can be formed through machining of the first distal end 214 or the second distal end 216 after the first electrode 210 or the second electrode 212, respectively, has been manufactured. As a non-limiting example, the non-planar topography can be formed during the manufacturing of the first electrode 210 or the second electrode 212 such that additional machining is not needed (e.g., the first electrode 210 or the second electrode 212 can be cast, additively manufactured, etc. with the non-planar topography). Alternatively, the non-planar topography can be a portion discrete, separate piece that is coupled to the remainder first electrode 210 or the second electrode 212. The non-planar topography can be coupled to the remainder of the first electrode 210 or the second electrode 212 through any suitable coupling method such as, but not limited to, welding, adhesion, magnetism, fastening, or any combination thereof.

The non-planar topography can be used to create a large local electric field at the tips or points of the knurled topography. This, in turn, can cause field emission to occur from the tips or points of the knurled topography. As a non-limiting example, the knurled topography can be used to generate triple-point emission from the second distal end 216 of the second electrode 212. The local electric field can be very high when compared to electrodes with a planar topography and an even higher local electric field when compared to glow discharge tubes without an electrode contacting a dielectric material and the electrode having a planar topography.

Figure 4:
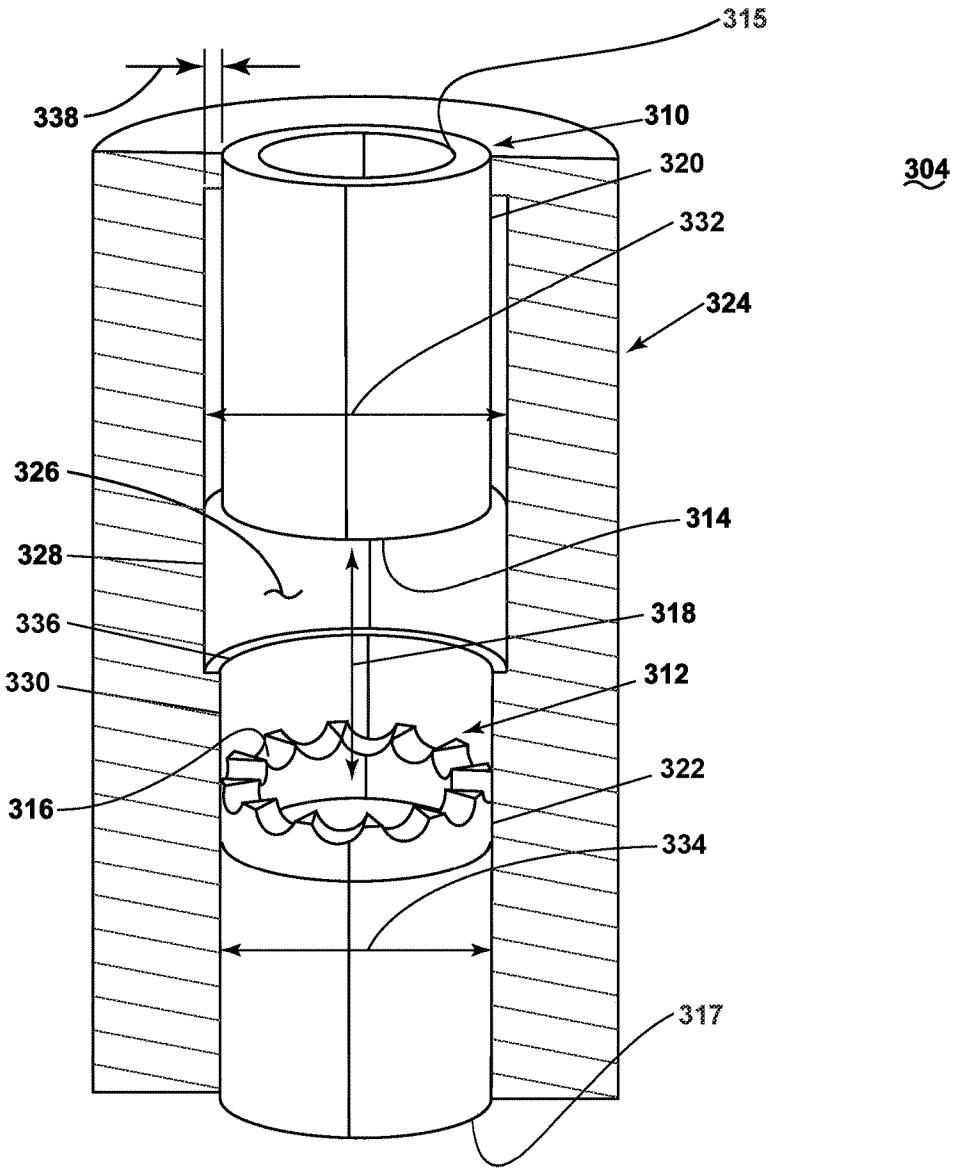
FIG. 4 is a cross-sectional perspective view of an exemplary glow discharge tube of FIG. 2, further illustrating another exemplary second electrode including an exemplary non-planar topography.

FIG. 4 is a cross-sectional perspective view of an exemplary glow discharge tube 304 of FIG. 2. The glow discharge tube 304 is similar to the glow discharge tube 104, 204, therefore, like parts will be identified with like numerals increased to the 300 series, with it being understood that the description of the like parts of the glow discharge tube 104, 204 applies to the glow discharge tube 304 unless otherwise noted. It will be appreciated that the glow discharge tube 304 can be suitable for use within the ignition device 100.

The glow discharge tube 304 is similar to the glow discharge tube 104, 204 as it includes a gas-sealed envelope 324 defining a second interior 326, a first electrode 310, and a second electrode 312, with both the first electrode 310 and the second electrode 312 being disposed within the second interior 326. The gas-sealed envelope 324 can be similar to the gas-sealed envelope 124, 224 in that it includes a first interior portion defined by a first interior surface 328 and defining a first cross-sectional area 332, a second interior portion defined by a second interior surface 330 and defining a second cross-sectional area 334, and a shelf 336 defining a transition region between the first cross-sectional area 332 and the second cross-sectional area 334. The first electrode 310 can be at least partially provided within or encased by the first interior portion of the gas-sealed envelope 324. The second electrode 312 can be at least partially provided within or encased by the second interior portion of the gas-sealed envelope 324. The first cross-sectional area 332 can be sized such that a gap 338 is formed between the first interior surface 328 and the first exterior surface 320, while the second cross-sectional area 334 can be sized such that the second interior surface 330 contacts the second electrode 312. The first electrode 310 can be similar to the first electrode 110, 210 in that it can include a first distal end 314 and a third distal end 315 interconnected by a first exterior surface 320. The second electrode 312 can be similar to the second electrode 112, 212 in that it includes a second distal end 316, opposing the first distal end 314, and a fourth distal end 317 interconnected by a second exterior surface 322. The first electrode 310 and the second electrode 312 can be spaced apart from one another such that first distal end 314 and the second distal end 316 can be spaced apart a distance 318 from one another.

The glow discharge tube 304 differs from the glow discharge tube 104 in that the first distal end 314 of the first electrode 310 and the second distal end 316 of the second electrode 312 do not include the same topography similar to the glow discharge tube 204. The first distal end 314, similar to the first distal end 114, 214, can include a planar or otherwise flat topography. The second distal end 316, similar to the second distal end 216, can be defined by a non-planar topography that is similar in function to the non-planar topography of the second distal end 216 in that it helps with creating field emission through use of triple-point emission. However, the non-planar topography of the second distal end 316 can differ from the non-planar topography of the second distal end 216. As a non-limiting example, the non-planar topography can be a peaks and valleys topography. It will be appreciated, however, that the non-planar topography can take any suitable non-planar topography such as, but not limited to, a castellated topography, a wave form topography, or any combination thereof.

Figure 5:
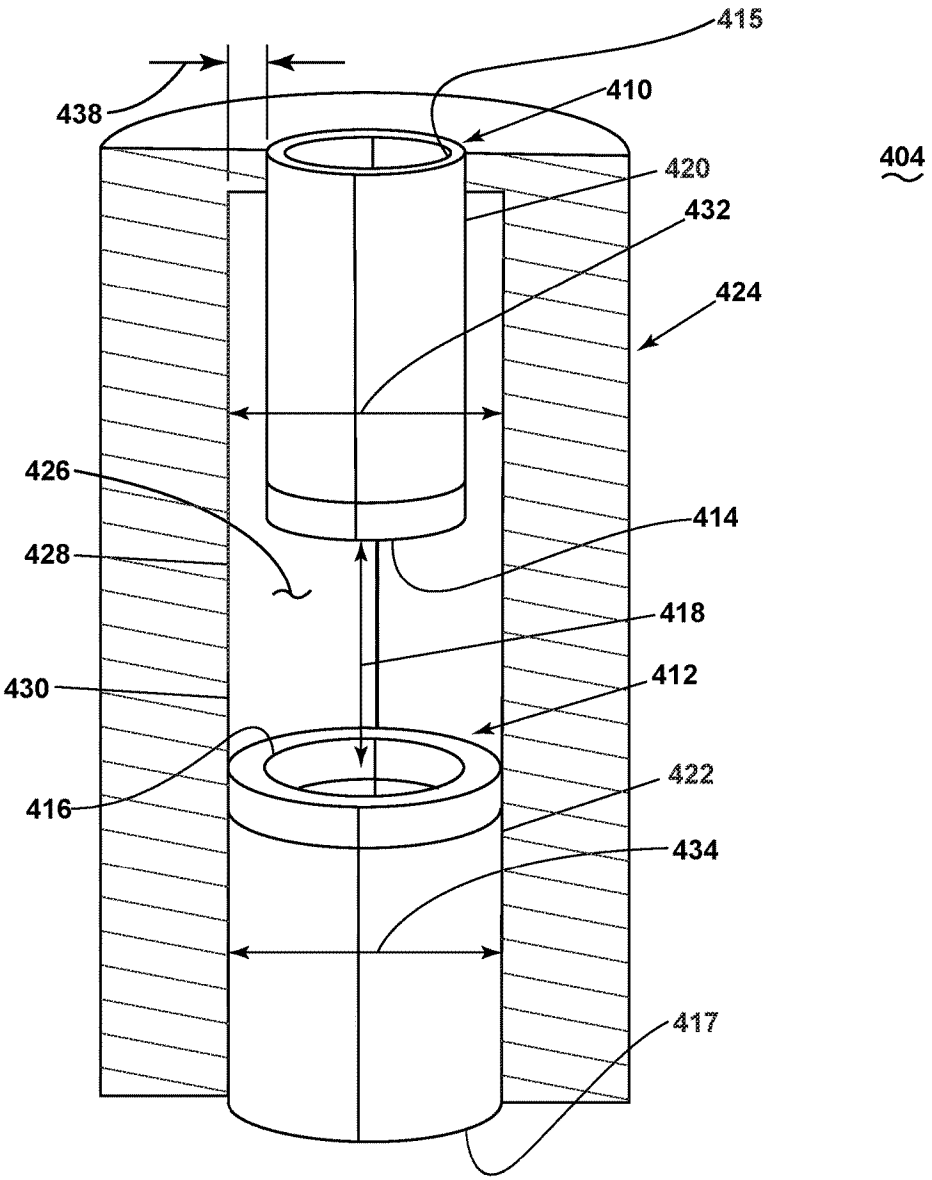
FIG. 5 is a cross-sectional perspective view of an exemplary glow discharge tube of FIG. 2, further illustrating an exemplary gas-sealed envelope including a constant cross-sectional area.

FIG. 5 is a cross-sectional perspective view of an exemplary glow discharge tube 404 of FIG. 2. The glow discharge tube 404 is similar to the glow discharge tube 104, 204, 304 therefore, like parts will be identified with like numerals increased to the 400 series, with it being understood that the description of the like parts of the glow discharge tube 104, 204, 304 applies to the glow discharge tube 404 unless otherwise noted. It will be appreciated that the glow discharge tube 404 can be suitable for use within the ignition device 100.

The glow discharge tube 404 is similar to the glow discharge tube 104, 204, 304 in that it includes a gas-sealed envelope 424 defining a second interior 426, a first electrode 410, and a second electrode 412. The gas-sealed envelope 424 can be similar to the gas-sealed envelope 124, 224, 324 in that it includes a first interior portion defined by a first interior surface 428 and defining a first cross-sectional area 432, and a second interior portion defined by a second interior surface 430 and defining a second cross-sectional area 434. The first electrode 410 can be at least partially provided within or encased by the first interior portion of the gas-sealed envelope 424. The second electrode 412 can be at least partially provided within or encased by the second interior portion of the gas-sealed envelope 424. The second cross-sectional area 434 can be sized such that the second interior surface 430 contacts the second electrode 412. The first electrode 410 can be similar to the first electrode 110, 210, 310 in that it can include a first distal end 414 and a third distal end 415 interconnected by a first exterior surface 420. The second electrode 412 can be similar to the second electrode 112, 212, 312 in that it includes a second distal end 416, opposing the first distal end 414, and a fourth distal end 417 interconnected by a second exterior surface 422. The first electrode 410 and the second electrode 412 can be spaced apart from one another such that first distal end 414 and the second distal end 416 can be spaced apart a distance 418 from one another.

The glow discharge tube 404 is similar to the glow discharge tube 104 in that the first electrode 410 and the second electrode 412 include a planar topography along the first distal end 414 and the second distal end 416, respectively. The gas-sealed envelope 424, however, differs from the gas-sealed envelope 124, 224, 324 as the first cross-sectional area 432 is equal to the second cross-sectional area 434. In other words, the cross-sectional area of the gas-sealed envelope 424 is constant along the entirety of the gas-sealed envelope 424. The second electrode 412, as illustrated, can have a smaller diameter than the first electrode 410. As such, a gap 438 can be formed between the first interior portion or the first interior surface 428 and the first electrode 410. In other words, the diameter of the first electrode 410 can be smaller than the diameter of the second electrode 412 and the first cross-sectional area 432.

Figure 6:
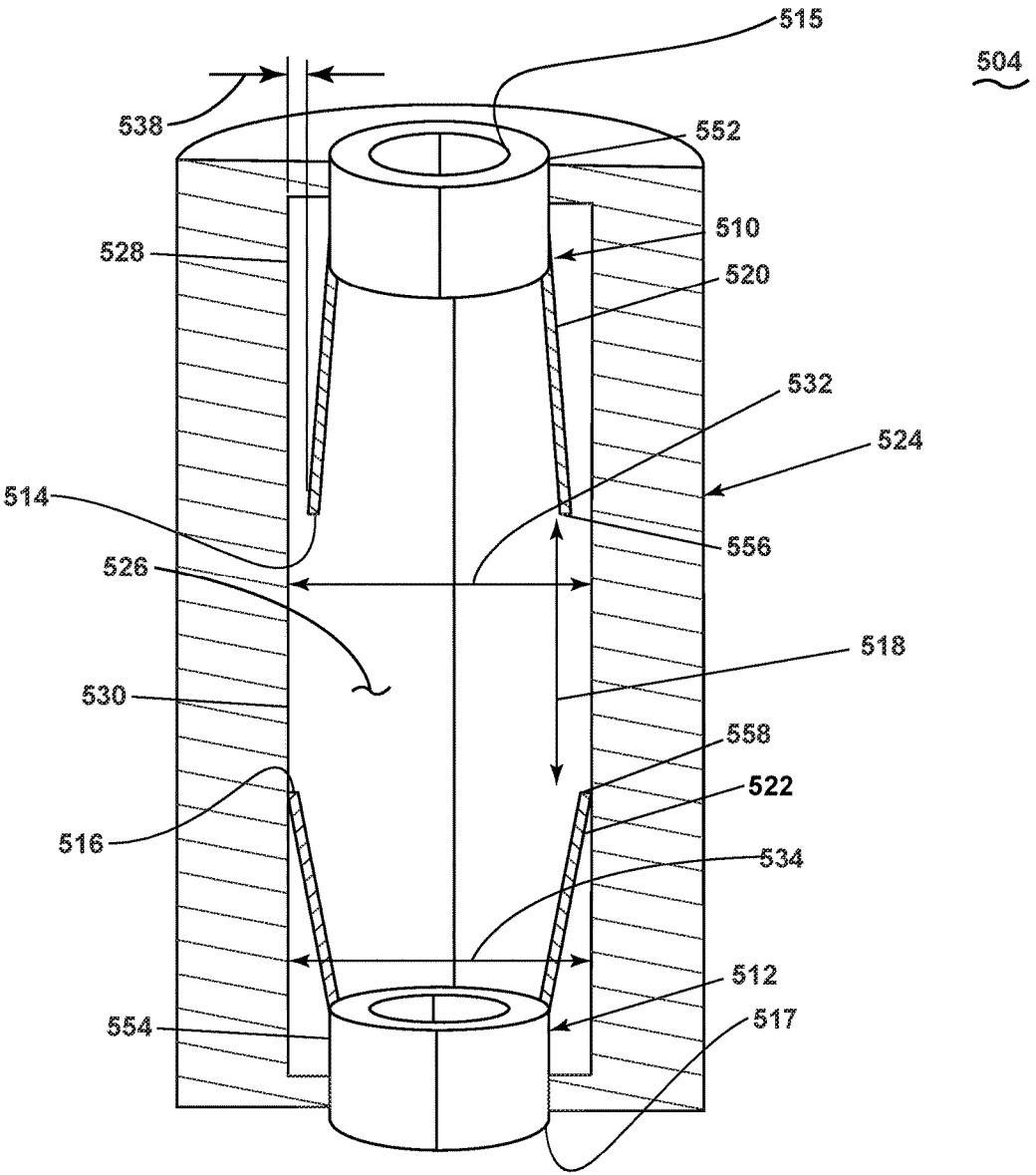
FIG. 6 is a cross-sectional perspective view of an exemplary glow discharge tube of FIG. 2, further including a first wire electrode and a second wire electrode.

FIG. 6 is a cross-sectional perspective view of an exemplary glow discharge tube 504 of FIG. 2. The glow discharge tube 504 is similar to the glow discharge tube 104, 204, 304, 404 therefore, like parts will be identified with like numerals increased to the 500 series, with it being understood that the description of the like parts of the glow discharge tube 104, 204, 304, 404 applies to the glow discharge tube 504 unless otherwise noted. It will be appreciated that the glow discharge tube 504 can be suitable for use within the ignition device 100.

The glow discharge tube 504 is similar to the glow discharge tube 104, 204, 304, 404 in that it includes a gas-sealed envelope 524 defining a second interior 526, a first electrode 510, and a second electrode 512. The gas-sealed envelope 524 can be similar to the gas-sealed envelope 124, 224, 324 in that it includes a first interior portion defined by a first interior surface 528 and defining a first cross-sectional area 532, a second interior portion defined by a second interior surface 530 and defining a second cross-sectional area 534. As illustrated, the gas-sealed envelope 524 can be similar to the gas-sealed envelope 424 as the first cross-sectional area 532 can be equal to the second cross-sectional area 534. It will be appreciated, however, that the gas-sealed envelope 524 can be formed similar to the gas-sealed envelope 124, 224, 324 such that the first cross-sectional area 532 is not equal to the second cross-sectional area 534. The first electrode 510 can be at least partially provided within or encased by the first interior portion of the gas-sealed envelope 524. The second electrode 512 can be at least partially provided within or encased by the second interior portion of the gas-sealed envelope 524. The second cross-sectional area 534 can be sized such that the second interior surface 530 contacts at least a portion of the second electrode 512. The first electrode 510 can be similar to the first electrode 110, 210, 310, 410 in that it can include a first distal end 514 and a third distal end 515 interconnected by a first exterior surface 520. The second electrode 512 can be similar to the second electrode 112, 212, 312, 412 in that it includes a second distal end 516, opposing the first distal end 514, and a fourth distal end 517 interconnected by a second exterior surface 522. The first electrode 510 and the second electrode 512 can be spaced apart from one another such that first distal end 514 and the second distal end 516 can be spaced apart a distance 518 from one another.

The first electrode 510 can include a first main body 552, while the second electrode 512 can include a second main body 554. The first main body 552 and the second main body 554 can be provided at opposing distal ends of the gas-sealed envelope 524. The first electrode 510 and the second electrode 512 differ from the first electrode 110, 210, 310, 410 and the second electrode 112, 212, 312, 412, respectively, however, as the first electrode 510 includes a first set of wires 556 and the second electrode 512 includes a second set of wires 558. As such, the first electrode 510 and the second electrode 512 can each be defined as wire electrodes.

The first set of wires 556 can extend from the first main body 552 of the first electrode 510 and toward at least a portion of the second electrode 512. The second set of wires 558 can extend form the second main body 554 of the second electrode 512 and toward at least a portion of the first electrode 510. Distal ends of the first set of wires 556 and the second set of wires 558 can define the first distal end 514 and the second distal end 516, respectively. The portion of the first set of wires 556 opposing the first interior surface 528 of the gas-sealed envelope 524 can at least partially define the first exterior surface 520. While the portion of the second set of wires 558 opposing the second interior surface 530 of the gas-sealed envelope 524 can at least partially define the second exterior surface 522.

It will be appreciated that the first set of wires 556 and the second set of wires 558 can further define a tapered portion of the first electrode 510 and the second electrode 512, respectively. As a non-limiting example, at least one of the first set of wires 556 can be tapered (e.g., angled) with respect to the first main body 552, or the second set of wires 558 can be tapered (e.g., angled) with respect to the second main body 554. As illustrated, the first set of wires 556 and the second set of wires 558, each include two wires provided at opposing ends of the first main body 552 and the second main body 554, respectively. It will be appreciated, however, that there can be any number of one or more first wires 556 or second wires 558 that extend across at least a portion of the first main body 552 or the second main body 554, respectively. As a non-limiting example, the first set of 556 can include a single first wire 556 that extends across the entirety circumference of the first main body 552 in a continuous fashion. In other words, the first wire 556 can form a frustoconical portion of the first electrode 510 that extends from the first main body 552 and confronting the second electrode 512.

Similar to the first electrode 110, 210, 310, 410, the first main body 552 and the first set of wires 556 do not come into contact with the first interior surface 528. As such, a gap 538 can be formed between the first distal end 514 or any other portion of the first exterior surface 520 defined by the first set of wires 556 and the first interior surface 528. Similar to the second electrode 112, 212, 312, 412, at least a portion of the first electrode 510 can come into contact with the gas-sealed envelope 524. As a non-limiting example, the second distal end 516 or any other portion of the second interior surface 530 defined by the second set of wires 558 can come into contact with the second interior surface 530 of the gas-sealed envelope 524.

Figure 7:
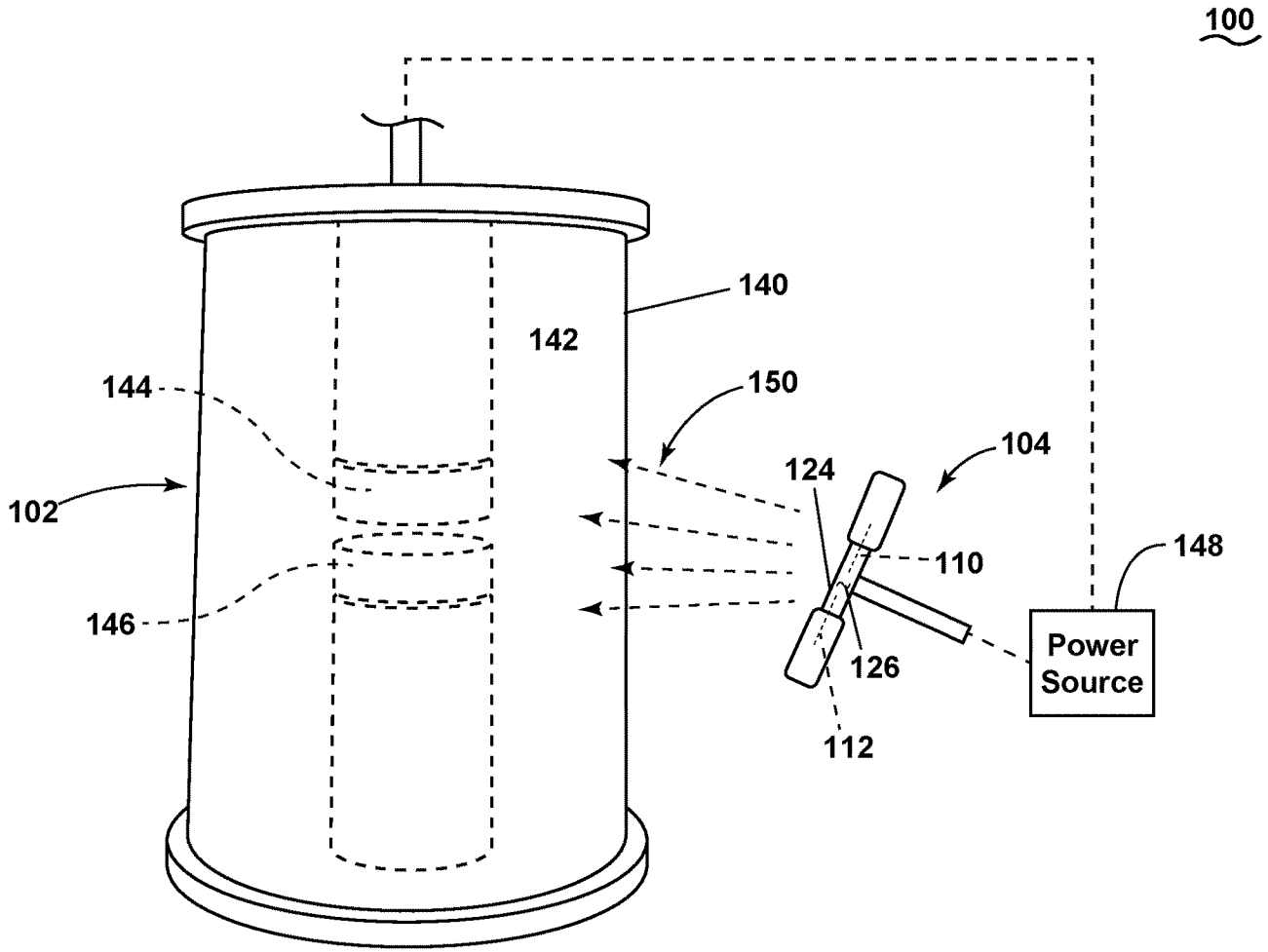
FIG. 7 is a cross-sectional perspective view of an exemplary glow discharge tube of FIG. 3, further illustrating another exemplary second electrode include a non-planar topography.

FIG. 7 is a schematic representation of the ignition device 100 of FIG. 1 in greater detail. As illustrated, the ignition device 100 can include the spark gap device 102 and the glow discharge tube 104 spaced apart from one another. Although described in terms of the ignition device 100 provided within the ignition system 30 of the turbine engine 10 (FIG. 1), it will be appreciated that the ignition device 100 can be used within any suitable ignition system 30 of any suitable combustion engine. It will be further appreciated that although described in terms of the glow discharge tube 104, that the glow discharge tube 104 can be any glow discharge tube 104, 204, 304, 404, 504 as described herein.

The spark gap device 102 can include a sealed environment 140 defining an interior 142. The sealed environment 140 can include any suitable material such as, but not limited to, and at least semi-transparent glass. As a non-limiting example, the sealed environment 140 can include any light-transmissive material. The interior 142 of the sealed environment 140 can be filled with any suitable non-radioactive gas similar to the interior 126. As a non-limiting example, the interior 142 can include an inert gas such as, but not limited to, nitrogen, argon, helium, neon, or any combination thereof. A set of opposing spark gap electrodes can be provided within the interior 142 and spaced apart from one another. As a non-limiting example, the set of opposing spark gap electrodes includes a first spark gap electrode 144 and a second spark gap electrode 146. The first spark gap electrode 144 and the second spark gap electrode 146, as illustrated, can include distal ends that oppose one another and are spaced apart to define a gap therebetween. The first spark gap electrode 144 and the second spark gap electrode 146 can further be defined by their relative charge with respect to one another. As a non-limiting example, the first spark gap electrode 144 can be positively charged, thus defining a cathode, while the second spark gap electrode 146 can be negatively charged, thus defining an anode.

As illustrated, the glow discharge tube 104 is provided exterior to the spark gap device 102. It will be appreciated, however, that at least a portion of the glow discharge tube 104 can be provided within the interior 142 of the sealed environment 140.

The ignition device 100 can further include or otherwise be operably coupled to a power source 148. The power source 148 can be any suitable power source that can supply a Direct Current (DC) voltage to at least one of the electrodes 110, 112, 144, 146 of the ignition device 100. The power source 148 can be operably coupled to the first spark gap electrode 144 such that the power source 148 can supply the DC voltage to the first spark gap electrode 144. As a result, a current (e.g., approximately 1 milli-Amp) can be generated within the interior 142 of the spark gap device 102. At least one of the first electrode 110 and the second electrode 112 of the glow discharge tube 104 can be coupled the first spark gap electrode 144, the second spark gap electrode 146, or both. As illustrated, the power source 148 of the glow discharge tube 104 may be the same as the power source 148 of the spark gap device 102.

During operation, the DC voltage is supplied to at least one of the first electrode 110 and the second electrode 112 from the power source 148. As a non-limiting example, the DC voltage can be supplied to the second electrode 112, thus defining the cathode. The DC voltage can cause the electric field to be generated between the first electrode 110 and the second electrode 112 and for field emission to occur within the glow discharge tube 104. As discussed herein, the field emission can generate the breakdown event and subsequent electron avalanche, which can ultimately generate a photon emission 150 (e.g., light emission) to be emitted from the glow discharge tube 104. With the photon emission 150, the glow discharge tube 104 can be defined as a light source for the ignition device 100. The amount of DC voltage can be used to adjust a wavelength, frequency, and/or amount of energy of the light emitted by the glow discharge tube 104. As a non-limiting example, the photon emission 150 can be defined by a wavelength of between 100 nanometers (nm) and 1000 nm, between 200 nm and 800 nm, or between 300 nm and 500 nm. It is contemplated that the wavelength of the glow discharge tube 104 (e.g., of the photon emission 150) may be adjusted by a gas composition within the glow discharge tube 104, and an intensity of the photon emission 150 may be adjusted by the power source 148 increasing or decreasing the amount of DC voltage supplied to the first electrode 110 and the second electrode 112.

As the sealed environment 140 includes a light-transmissive material (e.g., glass), the photon emission 150 can pass through the sealed environment 140 and impinge or otherwise be incident on at least one surface of the first spark gap electrode 144, the second spark gap electrode 146, or the first spark gap electrode 144 and the second spark gap electrode 146. In either case, when the photon emission 150 impinges the first spark gap electrode 144, and/or the second spark gap electrode 146, the first spark gap electrode 144, and the second spark gap electrode 146 can absorb at least a portion of the photon emission 150. This, in turn, causes the electrode that absorbed the photon to emit an electron. It is contemplated that the energy of the photon emission 150 must exceed the work-function of the material of the first spark gap electrode 144 and the second spark gap electrode 146 in order for electron emission to occur. The energy $\varepsilon$ of a photon is related to its wavelength $\lambda$ through the expression $\varepsilon=hc/\lambda$, where h is Planck's constant, c is the speed of light. In practical units $\varepsilon=1240/\lambda$, where $\varepsilon$ is in units of electron-volts and is in units of nanometers. With this in mind, the wavelength of the photon emission 150 will be dependent on the work-function of the materials. As a non-limiting example, if the work-function of the material is 2-6 electron-voltage, the wavelength of the photon emission 150 would need to be within a range of 200-600 nm. It will be further appreciated that the material of the sealed environment 140 can affect the wavelength of the photon emission 150. As a non-limiting example, borosilicate glass absorbs strongly at wavelengths less than 300 nanometers, corresponding to an energy of 4 electron-volts. So, if, by way of example, a given material has a work-function of 3 electron-volts, and a glow discharge tube 104 is placed outside the sealed environment 140 to create the photon emission 150, then only photons of energy 3-4 electron volts (300-400 nanometers) will be effective. A photon emission 150 including a wavelength longer than 400 nanometers will not have sufficient energy to cause photon emission, and photons with wavelength shorter than 300 nanometers will be absorbed by the glass. Thus, the material of the first spark gap electrode 144, and the second spark gap electrode 146, the wavelength of the photon emission 150, and the transmissive properties of the sealed environment 140 are all factors to be considered in the design and configuration or a spark gap system as discussed herein. As discussed herein, at least a portion of the glow discharge tube 104 can be provided within the sealed environment 140.

With the preceding in mind, the glow discharge tube 104 can be located with respect to the first spark gap electrode 144 and the second spark gap electrode 146 such that the photon emission 150 is incident on a surface of at least one of the first spark gap electrode 144 or the second spark gap electrode 146. This, in turn, causes the first spark gap electrode 144 or the second spark gap electrode 146 to emit electrons via the photo-electric effect. These electrons are then available to imitate a gas discharge or a breakdown event. These electrons are then available to initiate the gas discharge or breakdown event. The breakdown event can ultimately generate an electron avalanche that can, in turn, cause the spark gap device 102 to fire or otherwise generate a spark, which can ultimately be used to ignite the fuel-air mixture within the combustion section 14 (FIG. 1) through the set of igniters 32 as discussed herein.

It is contemplated that the electrode (e.g., the first spark gap electrode 144 and the second spark gap electrode 146) on which photon emission 150 from the glow discharge tube 104 are incident and which emits electrons can be, but is not limited to, a conventional electrode (e.g., a conventional conductive metal substrate and surface), an electrode having coated surface or other emissive coating (e.g., a special purpose emissive coating), or a photoelectrode (e.g., a photocathode or other an annular electrode or coil having a coating or composition specifically for the purpose of emitting electrons in response to light photons).

It is further contemplated that the power source 148 can be configured to apply sufficient voltage to the glow discharge tube 104 before supplying sufficient voltage to the spark gap device 102. This can allow for time to initiate the glow discharge tube 104 and generate the photon emission 150. As a non-limiting example, the power source 148 may provide voltage to the glow discharge tube 104 between 100 milliseconds (ms) and 200 ms before a desired time for the spark gap device 102 to fire.

Benefits of the present disclosure include a glow discharge tube that is consistently operably under a wide range of conditions including dark conditions when compared to conventional glow discharge tubes. For example, conventional glow discharge tubes rely on a pair of spaced electrodes received within a sealed tube. In this case, the electrodes both include planar surfaces and are not in contact with any dielectric material. As such, when the conventional glow discharge tube is under dark conditions the capability for electron breakdown and the photon emission to be generated is greatly inhibited. Conventional glow discharge tubes can rely on intervention from additional components (e.g., a high voltage trigger transformer external the conventional glow discharge tube) in order to produce the needed field emission, which can ultimately create the photon emission from the conventional glow discharge tube. In conventional glow discharge tubes, electron breakdown and photon emission can occur over time as the free electron will eventually be generated within the glow discharge tube. However, this process can take time, so if response time is critical (e.g., photon emission is required in a short amount of time after the DC current is supplied to the glow discharge tube), the conventional glow discharge tube might not be able to satisfy the time requirement. The glow discharge tube as described herein, however, includes components that can enhance the generation of the electric field that ultimately causes field emission, the breakdown event, the electron avalanche, and ultimately the photon emission. As a non-limiting example, the gas-sealed envelope can help enhance the generation of the electric field. As the gas-sealed envelope includes a dielectric material, and the cathode contacts the dielectric material, the gas-sealed envelope can aid in the generation of the electric field within the glow discharge tube. As another non-limiting example, the non-planar topography of at least the cathode can enhance the generation of the electric field. As discussed herein, the non-planar topography can generate a large local electric field which can be used to generate the electric field between the electrodes. With the gas-sealed envelope made of a dielectric material, the contact between the cathode and the dielectric material, and the non-planar topography, triple-point emission can occur. The triple-point emission can, in turn, generate a very high electric field (e.g., 10-20V/micron) when compared to the electric field in the conventional glow discharge tube. The very high electric field can ultimately initiate the field emission within the glow discharge tube, without the need for intervention from additional components. As such, the electric field can be generated within a wider range of operating conditions, including the dark conditions as discussed herein. Further, it is contemplated that the high electric field can cause the first free electron to be generated, and the subsequent electron avalanche and photon emission to occur quicker when compared to conventional glow discharge tubes. As such, the glow discharge tube as described herein allows for generation of the photon emission under a wide variety of operating conditions, within the required time frame, with relative ease when compared to conventional glow discharge tubes.

Further benefits of the present disclosure include an ignition device without any radioactive gases when compared to conventional ignition devices. For example, conventional ignition device relies on radioactive gases (e.g. krypton-85) within their respective sealed environments in order to generate field emission and sparks. The ignition device as described herein, however, allows for these radioactive materials to be eliminated from the gas mixture typically present within the spark gap device and the glow discharge tube while still maintaining the same performance and function of the ignition device. The present approach utilizes the photo-electric effect, using a light source (e.g., the glow discharge tube) with a specific nominal wave length (or range of wavelengths) at a specific level of emitted flux to generate seed electrons. The light source is located with respect to a surface of at least one of the electrodes within the spark gap device and the emitted photons landing incident on the surface of the electrode(s) cause at least one of them to emit electrons needed to initiate the gas discharge or breakdown event. The present approach may be retrofit in existing packaging, such that there would be no major changes in the manufacturing a the spark gap device, the glow discharge tube, or the remainder of the ignition system.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are provided by the subject matter of the following clauses:

A glow discharge tube comprising a gas-sealed envelope defining an interior with an interior surface defining a first interior portion with a first interior surface and a second interior portion with a second interior surface, a first electrode having a first portion with a first exterior surface located within the first interior portion, and a second electrode having a second portion with a second exterior surface located within the second interior portion and at least a portion of the second exterior surface is in contact with the second interior surface.

The glow discharge tube of any of the preceding clauses, wherein the first portion terminates in a first end and the second portion terminates in a second end, confronting and spaced from the first end.

The glow discharge tube of any of the preceding, wherein at least one of the first end or the second end includes a non-planar topography.

The glow discharge tube of any of the preceding, wherein the second surface includes the non-planar topography.

The glow discharge tube of any of the preceding, wherein the first electrode is an anode and the second electrode is a cathode.

The glow discharge tube of any of the preceding, wherein the non-planar topography is at least one of a castellated topography, a wave form topography, a peaks and valleys topography, or a knurled topography.

The glow discharge tube of any of the preceding, wherein the non-planar topography is a knurled topography.

The glow discharge tube of any of the preceding, wherein the non-planar topography is a peaks and valleys topography.

The glow discharge tube of any of the preceding, wherein the first interior portion is defined by a first cross-sectional area normal to the first interior surface, and the second interior portion is defined by a second cross-sectional area normal to the second interior surface, with the first cross-sectional area being larger than the second cross-sectional area.

The glow discharge tube of any of the preceding, wherein the first exterior surface is spaced from the first interior surface to define a gap between the first electrode and the gas-sealed envelope.

The glow discharge tube of any of the preceding, wherein the gap is 0.1 mm.

The glow discharge tube of any of the preceding, wherein the first electrode and the second electrode are spaced a distance of between 3 mm and 6 mm from one another.

The glow discharge tube of any of the preceding, wherein the first electrode includes a first set of wires and the second electrode includes a second set of wires confronting the first set of wires, and wherein the first set of wires defines the first exterior surface and the second set of wires defines the second exterior surface.

The glow discharge tube of any of the preceding, wherein the first electrode is an anode and the second electrode is a cathode.

The glow discharge tube of any of the preceding, wherein at least one of the first electrode or the second electrode are operatively coupled to a power source which supplies a current to at least one of the first electrode or the second electrode to generate an electric field between the first electrode and the second electrode.

The glow discharge tube of any of the preceding, wherein the electric field can be between 10 and 20 Volts/micron.

The glow discharge tube of any of the preceding, wherein the gas-sealed envelope includes a dielectric glass.

An ignition device, comprising a spark gap device comprising a first spark gap electrode, a second spark gap electrode spaced from and opposing the first spark gap electrode, and a glow discharge tube comprising a gas-sealed envelope defining an interior with an interior surface defining a first interior portion with a first interior surface and a second interior portion with a second interior surface, a first electrode having a first portion with a first exterior surface located within the first interior portion, and a second electrode having a second portion with a second exterior surface located within the second interior portion and at least a portion of the second exterior surface is in contact with the second interior surface.

The ignition device of any of the preceding, wherein the first electrode is an anode and the second electrode is a cathode, and at least a portion of the second electrode includes a non-planar topography.

The ignition device of any of the preceding, wherein the non-planar topography is at least one of a castellated topography, a wave form topography, a peaks and valleys topography, or a knurled topography.

What is claimed is:

1. A glow discharge tube comprising:

a gas-sealed envelope defining an interior with an interior surface defining a first interior portion with a first interior surface and a second interior portion with a second interior surface;

a first electrode having a first portion and a first exterior surface at least a portion of the first electrode being located within the first interior portion; and a second electrode having:

a first distal end, a second distal end space from and facing the first electrode; and a second exterior surface located within the second interior portion and interconnecting the first distal end and the second distal end, with at least a portion of the second exterior surface directly contacting at least a portion of the second interior surface.

2. A glow discharge tube comprising:

a gas-sealed envelope defining an interior with an interior surface having:

a first interior portion with a first interior surface, the first interior portion having a first cross-sectional area normal to the first interior surface;

a second interior portion with a second interior surface, the second interior portion having a second cross-sectional area normal to the second interior surface, with the first cross-sectional area being larger than the second cross-sectional area;

a first electrode having a first distal end and a first exterior surface, at least a portion of the first electrode being located within the first interior portion; and a second electrode having a second distal end and a second exterior surface, the second distal end spaced from and facing the first distal end and the second exterior surface being located within the second interior portion, with at least a portion of the second exterior surface is in contact with the second interior surface.

3. The glow discharge tube of claim 1, wherein the first exterior surface is spaced from the first interior surface to define a gap between the first electrode and the gas-sealed envelope.

4. The glow discharge tube of claim 3, wherein the gap is 0.1 mm.

5. The glow discharge tube of claim 1, wherein the first electrode and the second electrode are spaced a distance of between 3 mm and 6 mm from one another.

6. The glow discharge tube of claim 1, wherein the first electrode includes a first set of wires and the second electrode includes a second set of wires confronting the first set of wires, and wherein the first set of wires defines the first exterior surface and the second set of wires defines the second exterior surface.

7. The glow discharge tube of claim 1, wherein the first electrode is an anode and the second electrode is a cathode.

8. The glow discharge tube of claim 1, wherein at least one of the first electrode or the second electrode are operatively coupled to a power source which supplies a current to at least one of the first electrode or the second electrode to generate an electric field between the first electrode and the second electrode.

9. The glow discharge tube of claim 8, wherein the electric field between 10 and 20 Volts/micron.

10. The glow discharge tube of claim 1, wherein the gas-sealed envelope includes a dielectric glass.

11. An ignition device including the glow discharge tube of claim 1, the ignition device having a spark gap device comprising:

a first spark gap electrode; and a second spark gap electrode spaced from and opposing the first spark gap electrode.

12. The ignition device of claim 11, wherein a voltage is supplied to one of either the first electrode or the second electrode to generate an electric field between the first electrode and the second electrode, with the electric field causing an electron break down event that generates a photon emission emitted from the glow discharge tube.

13. The ignition device of claim 12, wherein the photon emission from the glow discharge tube is incident on at least one of either the first spark gap electrode or the second spark gap electrode.

14. A glow discharge tube comprising:

a gas-sealed envelope defining an interior with an interior surface defining a first interior portion with a first interior surface and a second interior portion with a second interior surface;

a first electrode having a first distal end and a first exterior surface, at least a portion of the first electrode being located within the first interior portion; and a second electrode having a second distal end and a second exterior surface, the second distal end spaced from and facing the first distal end and the second exterior surface being located within the second interior portion, with at least a portion of the second exterior surface is in contact with the second interior surface;

wherein at least one of the first distal end or the second distal end includes a non-planar topography.

15. The glow discharge tube of claim 14, wherein the second distal end includes the non-planar topography.

16. The glow discharge tube of claim 15, wherein the first electrode is an anode and the second electrode is a cathode.

17. The glow discharge tube of claim 14, wherein the non-planar topography is at least one of a castellated topography, a wave form topography, a peaks and valleys topography, or a knurled topography.

18. The glow discharge tube of claim 17, wherein the non-planar topography is the knurled topography.

19. The glow discharge tube of claim 17, wherein the non-planar topography is the peaks and valleys topography.

20. The glow discharge tube of claim 2 wherein the first interior portion terminates in a first end and the second interior portion terminates in a second end, confronting and spaced from the first end.

* * * * *